United States Patent [19]

Hagstrom et al.

[11] Patent Number: 4,496,200

[45] Date of Patent: Jan. 29, 1985

[54] DESK TOP KEYBOARD DISPLAY TERMINAL WITH AN ARTICULATED KEYBOARD

[75] Inventors: Arthur A. Hagstrom, Hoffman Estates; Carl D. Swanson, Arlington Heights, both of Ill.

[73] Assignee: Teletype Corporation, Skokie, Ill.

[21] Appl. No.: 430,580

[22] Filed: Sep. 30, 1982

[51] Int. Cl.[3] ..... A47B 21/00

[52] U.S. Cl. ..... 312/208; 108/138; 108/143; 211/151; 248/442.2; 248/447; 312/27; 312/282; 312/333

[58] Field of Search ..... 312/208, 196, 24, 27, 312/328, 272.5; 108/102, 5, 138, 143; 211/151; 312/282, 333; 248/442.2, 447

[56] References Cited

U.S. PATENT DOCUMENTS

| | | | |
|---|---|---|---|
| 883,305 | 3/1908 | Fetch | 312/27 |
| 1,965,370 | 7/1934 | Cohn | 312/24 X |
| 2,585,566 | 2/1952 | Lundstrom | 312/27 |
| 2,833,499 | 5/1958 | Lysedahl | 248/442.2 |
| 3,428,382 | 2/1969 | Yarnell | 312/208 |
| 3,778,125 | 12/1973 | Gutmann, Jr. et al | 312/208 X |
| 4,184,725 | 1/1980 | Spangler | 248/447 |
| 4,194,452 | 3/1980 | Crowther et al. | 108/138 |
| 4,313,112 | 1/1982 | Foster | 312/196 X |
| 4,316,082 | 2/1982 | Fritz | 312/208 X |
| 4,379,429 | 4/1983 | Gubbe et al. | 108/5 |

FOREIGN PATENT DOCUMENTS

| | | | |
|---|---|---|---|
| 799674 | 6/1936 | France | 312/208 |

*Primary Examiner*—William E. Lyddane
*Assistant Examiner*—Thomas A. Rendos
*Attorney, Agent, or Firm*—Algis A. Tirva

[57] ABSTRACT

A desk top keyboard display terminal includes a keyboard which may be latched to the front of the terminal or articulated over the edge of a desk to a level convenient for a typist.

3 Claims, 5 Drawing Figures

DESK TOP KEYBOARD DISPLAY TERMINAL WITH AN ARTICULATED KEYBOARD

DESCRIPTION

TECHNICAL FIELD

This invention relates to desk top keyboard CRT (cathode ray tube) display terminals and more particularly to the keyboard mounting arrangement utilized in such terminals.

BACKGROUND ART

Desk top keyboard CRT display terminals have been available commercially for a number of years, and because of the many attractive features offered by these terminals their use has been increasing steadily from year to year. These terminals have been especially well accepted in offices, and such terminals in combination with hard copy printing devices are rapidly replacing conventional typewriters.

Commercial keyboard display terminals are available in two basic configurations. One type of terminal has a display screen located on the top of a pedestal and a keyboard mounted on the front of the pedestal. The pedestal may also house the electronics for the display screen, keyboard, and any interface if required.

A second type has a detached stand alone keyboard connected to the electronics and the display screen via an umbiblical cord. In most cases when keyboard display terminals of either configuration are introduced into an office, they are placed on top of desks already in place. While for occasional use a keyboard located on a desk top is satisfactory, for extended typing tasks arm fatigue and general operator discomfort caused by the elevated position of the keyboard requires an adjustment to the height of the keyboard. One obvious solution is to place the terminal with an attached keyboard or a stand alone keyboard on a typewriter stand which positions the keyboard at a level convenient for a typist. This level has been determined to place the home row (ASDFG . . . keys) of the keyboard approximately 29½ inches above the floor level. However, need for the special furniture, as well as the floor space required for it, is an expense which often may prohibit use of such terminals.

DISCLOSURE OF INVENTION

In accordance with the present invention, we provide a desk top keyboard display terminal wherein the terminal includes a pedestal, a CRT display mounted on top of the pedestal, and an articulated keyboard mounted on the front of the pedestal.

THE DRAWING

DETAILED DESCRIPTION

Figure 1:
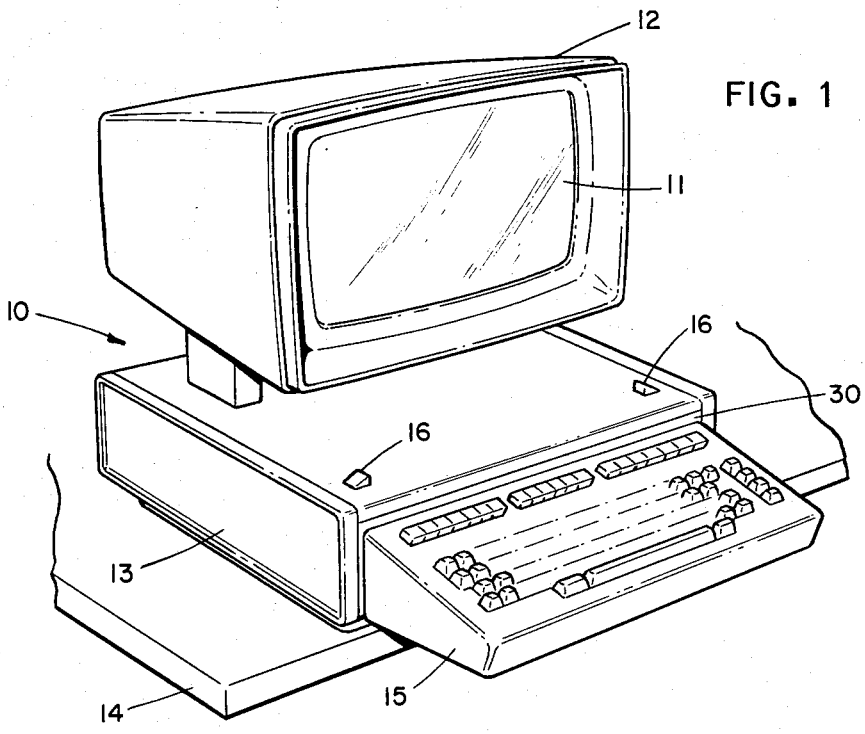
FIG. 1 is a sketch in front perspective view of a desk top mounted keyboard display terminal having a keyboard attached to the front of its pedestal.
Figure 2:
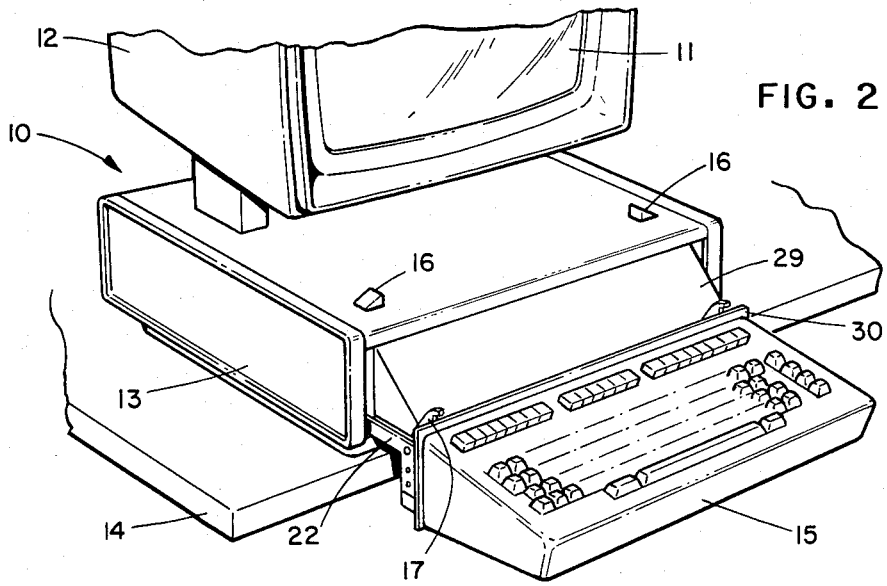
FIG. 2 is a view of the terminal shown in FIG. 1 showing the keyboard articulated away from the pedestal and over the edge of a desk in accordance with the invention.

FIGS. 1 and 2 show a keyboard display terminal 10 in accordance with the invention. The terminal 10 includes a CRT display 11 located in a housing 12 which in turn is movably mounted on top of a pedestal 13. The pedestal 13 has a substantially rectangular shape and houses the electronics associated with the terminal 10. The pedestal 13 is arranged to be located on a flat surface such as a top of a desk 14 which is partially shown in FIGS. 1 and 2.

As shown in FIG. 1, a keyboard 15 is mounted on a movable front portion 30 of the pedestal 13 and is held in place by a latching mechanism (not shown in FIG. 1) located within the pedestal 13. A pair of spring loaded movable latches 16, having their top portions located on top of the pedestal 13, extend through openings (not shown) in the top surface of the pedestal 13 into the pedestal 13. The spring loaded latches 16 normally engage the latching mechanism and hold the keyboard 15 cantilevered from the front of the pedestal 13 and above the mounting surface of the pedestal 13. The suspension of the keyboard 15 above the terminal 10 mounting surface permits the terminal 10 to be easily moved to any portion of the desk 14.

FIG. 2 shows the keyboard 15 in its articulated position away from the front of the pedestal 13 and over and below an edge of desk 14. This is accomplished by moving the terminal 10 towards one of the edges of the desk 14 so as to position most of the keyboard 15 over an edge of the desk 14. Spring loaded latches 16 are then moved until they disengage the latching mechanism allowing the keyboard 15 to move away from the pedestal 13.

Figure 3:
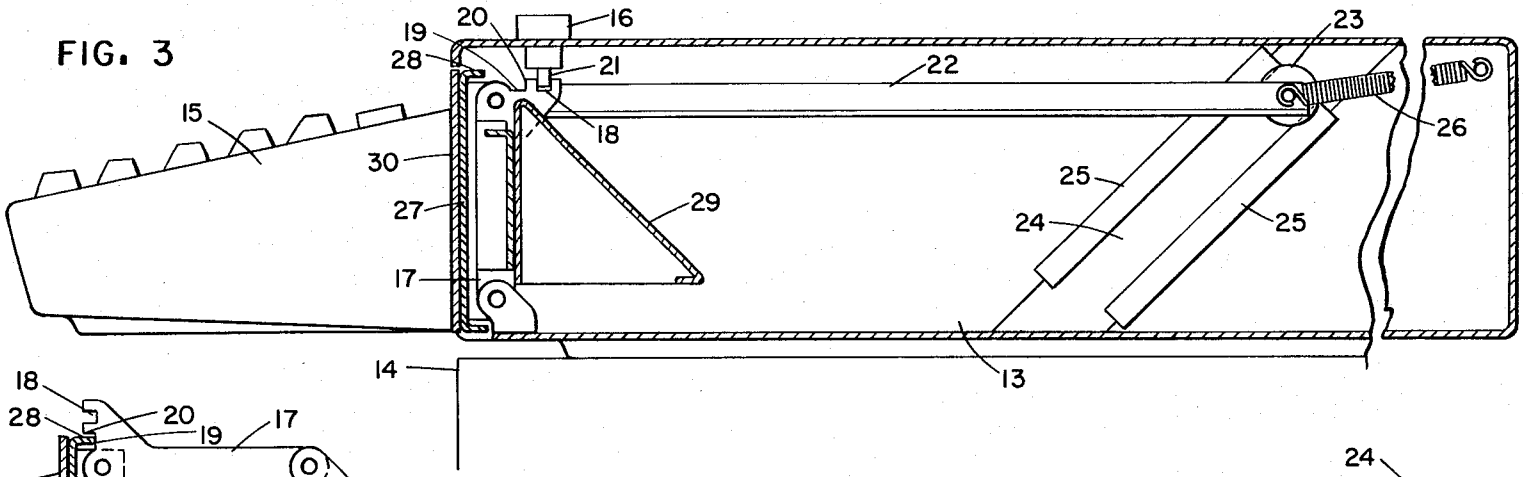
FIG. 3 is a cross section view illustrating the latching and articulating mechanisms of the terminal as shown in FIG. 1.
Figure 4A:
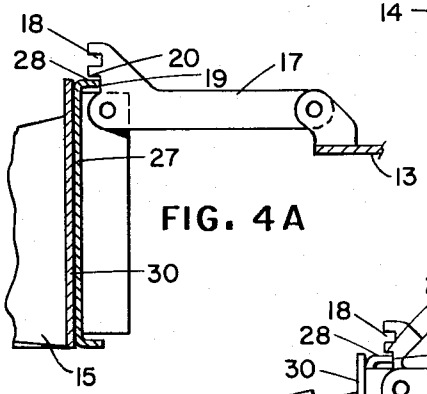
FIG. 4*a* is a detailed view of the latching mechanism shown in FIGS. 3 and 4.
Figure 4:
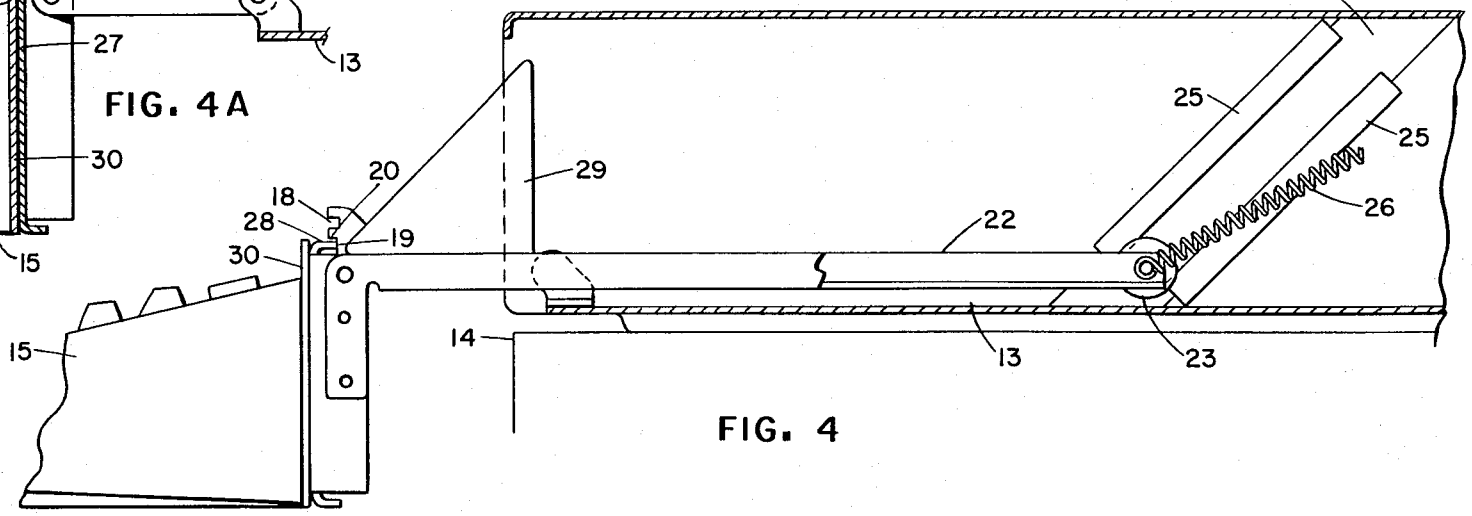
FIG. 4 is a cross section view illustrating the latching and articulating mechanisms of the terminal as shown in FIG. 2.

FIGS. 3, 4, and 4*a* show the keyboard 15 latching and articulating mechanisms. The latching mechanism includes a pair of substantially identical and parallel members 17 of which only one is shown in the drawing. Each member 17 has one end pivotably connected to the keyboard 15. The end of each member 17 connected to keyboard 15 has a slot 18 and a recess 19 which includes a shoulder 20. The latching mechanism further includes the spring loaded latches 16 each having a portion terminating in a tab 21 which projects downward into the pedestal 13. Tabs 21 normally engage slots 18 of the members 17, which have their longitudinal axes in a substantially vertical position when the keyboard 15 is held against the front of the pedestal 13. Once tabs 21 enter their respective slots 18, members 17 are prevented from further movement and the keyboard 15 is latched to the pedestal 13.

The keyboard 15 articulating mechanism includes the pivotably connected members 17 and a pair of substantially identical and parallel links 22 only one of which is shown in the drawing. Each link 22 has a roller 23 rotatably mounted on one end while the other end is firmly attached to keyboard 15. Each roller 23 is arranged to move along one of the two substantially identical inclined planes 24 of which only one is shown in the drawing. The rollers 23 are restricted to movement along each of the inclined planes 24 by a pair of guides 25 associated with each inclined plane 24.

The keyboard 15 is articulated to a predetermined position by moving the spring loaded latches 16 until the tabs 21 exit from their respective slots 18 allowing members 17 to pivot about their pivotably connected ends and thus allowing the keyboard 15 to move away from the pedestal 13 and at the same time to drop down over the edge of the desk 14. As the keyboard 15 moves away and down from the pedestal 13 and the longitudinal axes of members 17 approach a substantially horizontal position, a lip 28 on a backing plate 27, which is mounted on the back of keyboard 15 and extends the width of the keyboard 15, enters recesses 19 located on members 17 and engages shoulders 20 preventing further pivoting around these ends of the members 17. Additionally, the movement of the keyboard 15 away and downward from the pedestal 13 is guided and controlled by links 22 since each of the rollers 23 mounted on the links 22 is restricted by the guides 25 to movement along one of the inclined planes 24.

As the keyboard 15 moves away and down from the pedestal 13, links 22, since they are attached to the keyboard 15, also move forward and descend at the same time to a level where they are substantially parallel to members 17. The descent of links 22 is controlled by the path rollers 23 have to take along their respective inclined planes 24.

The length of the members 17 determine the distance that the keyboard 15 moves away from the pedestal 13, as well as, the distance that the keyboard 15 moves down to the new articulated level. The angle of each of the inclined planes 24 is approximately 45 degrees because, as shown in FIGS. 3 and 4, when the keyboard 15 is moved from the front of the pedestal 13 to its articulated position, rollers 23 have to move a vertical distance equal to the length of the members 17 while at the same time moving an equal horizontal distance.

A pair of springs 26, only one of which is shown in the drawing, each spring having one end connected to the pedestal 13 and the other end to the end of a link 22 with the roller 23, further restrains the movement of the links 22.

FIGS. 2 and 4 show a copy holder 29 which has a substantially triangular shape and extends the width of the keyboard 15. The copy holder 29 has each of its ends firmly attached to a different one of the pivotably mounted members 17. When the keyboard 15 is returned from its articulated position, as shown in FIG. 2, to its position in front of the pedestal 13, copy holder 29 is moved by the members 17 inside the pedestal 13, as shown by FIG. 3.

We claim:

1. A desk top keyboard display terminal comprising:

a pedestal forming an enclosure and having at least top, bottom and front surfaces;

a housing for containing a CRT display, the housing mounted on top of the pedestal;

a keyboard mounted on the front surface of the pedestal; and means for latching the keyboard to the pedestal, the means includes two substantially parallel members, each member having one end pivotably connected to the keyboard and the other end to the pedestal, each end connected to the keyboard having a slot;

a pair of movable spring loaded latches, each having a portion located above the top of the pedestal and each having a portion terminating in a tab projecting into the pedestal, wherein the tabs are arranged to engage the slots when the keyboard is moved up against the front of the pedestal, preventing further movement of the two pivotably connected members, thereby latching the keyboard to the front of the pedestal.

2. The keyboard display terminal in accordance with claim 1 wherein the terminal includes a copy holder having a substantially triangular shape extending the length of the keyboard and having each end attached to a different one of the members.

3. A desk top keyboard display terminal comprising:

a pedestal forming an enclosure and having at least top, bottom and front surfaces;

a housing for containing a CRT display, the housing mounted in top of the pedestal;

a keyboard mounted on the front surface of the pedestal;

means for latching the keyboard to the pedestal;

means for articulating the keyboard away from the pedestal to a predetermined level below the pedestal, the means includes two substantially parallel links, each having one end firmly attached to the keyboard and each having a roller rotatably mounted on the other end;

a pair of inclined planes of a predetermined angle located within the pedestal, each plane associated with a respective link and each having a pair of guides arranged to accommodate the roller mounted on the link and to restrict the movement of the roller to movement along the inclined plane; and a pair of springs, each having one end attached to the pedestal and the other end attached to the end of a different one of the links with the roller mounted on it, the springs exerting a minimum force on the links when the keyboard is latched to the front of the pedestal and exerting a maximum force when the keyboard is in its articulated position.

* * * * *